US011453419B2

(12) United States Patent
Weitersberger et al.

(10) Patent No.: US 11,453,419 B2
(45) Date of Patent: Sep. 27, 2022

(54) ON-TRACK WORK- OR RESCUE VEHICLE

(71) Applicant: PLASSER & THEURER EXPORT VON BAHNBAUMASCHINEN GMBH, Vienna (AT)

(72) Inventors: Christian Weitersberger, St. Georgen an der Gusen (AT); Christoph Kaiser, St. Stefan am Walde (AT)

(73) Assignee: Plasser & Theurer Export von Bahnbaumaschinen GmbH, Vienna (AT)

( * ) Notice: Subject to any disclaimer, the term of this patent is extended or adjusted under 35 U.S.C. 154(b) by 573 days.

(21) Appl. No.: 16/481,713

(22) PCT Filed: Dec. 22, 2017

(86) PCT No.: PCT/EP2017/084324
§ 371 (c)(1),
(2) Date: Jul. 29, 2019

(87) PCT Pub. No.: WO2018/137871
PCT Pub. Date: Aug. 2, 2018

(65) Prior Publication Data

US 2019/0389492 A1 Dec. 26, 2019

(30) Foreign Application Priority Data

Jan. 27, 2017 (AT) ..... GM 23/2017

(51) Int. Cl.
*B61D 15/00* (2006.01)
*A62C 3/02* (2006.01)
(Continued)

(52) U.S. Cl.
CPC ..... *B61D 15/00* (2013.01); *A62C 3/0221* (2013.01); *A62C 27/00* (2013.01); *B61C 3/00* (2013.01); *B61D 5/00* (2013.01); *B61D 27/0018* (2013.01)

(58) Field of Classification Search
CPC ..... B61D 15/00; B61D 5/00; B61D 27/0018; A62C 3/0221; A62C 3/0292; A62C 27/00;
(Continued)

(56) References Cited

U.S. PATENT DOCUMENTS 1,868,340 A * 7/1932 Woodard ..... B61F 3/10 105/404
3,709,153 A * 1/1973 Herscovitch ..... B61J 3/12 213/50
(Continued)

FOREIGN PATENT DOCUMENTS

AT 386164 B 7/1988
CN 102058944 A 5/2011
(Continued)

*Primary Examiner* — Zachary L Kuhfuss
(74) *Attorney, Agent, or Firm* — Laurence A. Greenberg; Werner H. Stemer; Ralph E. Locher

(57) ABSTRACT

An on-track work or rescue vehicle for fire-fighting and/or the rescue of persons in tunnels or subway tubes has a drive which can be operated for at least a limited duration without ambient air. A liquid tank is arranged on the work or rescue vehicle. A fan blower with a fluid spraying device is connected to the liquid tank for producing a spray mist. The work or rescue vehicle is a traction vehicle for pulling or pushing other rail vehicles. A work or rescue vehicle of this type can move to a fire source under the protection of the spray mist blown into the tunnel or subway tube and, if required, pull or push a damaged rail vehicle from a danger zone.

10 Claims, 1 Drawing Sheet

(51) Int. Cl.

| | |
|---|---|
| ***A62C 27/00*** | (2006.01) |
| ***B61C 3/00*** | (2006.01) |
| ***B61D 5/00*** | (2006.01) |
| ***B61D 27/00*** | (2006.01) |

(58) Field of Classification Search
CPC . A62C 35/023; B61C 3/00; E21F 1/00; E21F 11/00; B05B 13/005
USPC ..... 105/238.1, 358
See application file for complete search history.

(56) References Cited

U.S. PATENT DOCUMENTS

| | | | | |
|---|---|---|---|---|
| 3,954,064 | A * | 5/1976 | Minovitch | H01F 7/0236 104/130.02 |
| 4,718,352 | A | 1/1988 | Theurer et al. | |
| 7,201,106 | B2 * | 4/2007 | Whiston | B61D 15/00 105/72.2 |
| 7,975,621 | B2 | 7/2011 | Gibson | |
| 2006/0260824 | A1 * | 11/2006 | Dillman | A62C 27/00 169/46 |
| 2007/0256842 | A1 * | 11/2007 | Mohr | A62C 3/02 169/46 |
| 2010/0083868 | A1 | 4/2010 | Gibson | |
| 2010/0252284 | A1 * | 10/2010 | Johansen | A62C 27/00 169/5 |

FOREIGN PATENT DOCUMENTS

| | | | | |
|---|---|---|---|---|
| CN | 102114849 | A | 7/2011 | |
| CN | 201925228 | U | 8/2011 | |
| CN | 104174133 | A | 12/2014 | |
| CN | 205168502 | U | 4/2016 | |
| DE | 10324917 | A1 | 12/2004 | |
| EP | 0887243 | A2 * | 12/1998 | B61D 15/00 |
| EP | 1391364 | A1 * | 2/2004 | B61D 17/046 |
| EP | 3795444 | A1 * | 3/2021 | B61D 15/00 |
| KR | 100623947 | B1 | 9/2006 | |
| WO | 0109484 | A2 | 2/2001 | |
| WO | 2016015520 | A1 | 2/2016 | |

* cited by examiner

ON-TRACK WORK- OR RESCUE VEHICLE

FIELD OF TECHNOLOGY

The invention relates to an on-track work- or rescue vehicle for fire-fighting and/or rescue of persons in tunnels or subway tubes, having a drive which can be operated for at least a limited duration without ambient air. The invention also relates to a corresponding method for fire-fighting and/or rescue of persons.

PRIOR ART

In the case of fires in difficult-to-access track sections such as tunnels or subway tubes, fire-fighting requires quick and effective measures in order to prevent personal injuries as well as infrastructure damages. Various fire-fighting vehicles are known which can be used as two-way vehicle. Such vehicles are equipped mainly for immediate fire-fighting, but less so for rescue measures.

According to AT 386 164 B, an on-track work- or rescue vehicle is known with which rescue operations in tunnels can be carried out. This rail vehicle comprises a combustion engine which can be supplied with compressed air for a limited time in order to enable travel in tunnels under oxygen deficiency.

SUMMARY OF THE INVENTION

It is the object of the invention to provide an improvement over the prior art for a work- or rescue vehicle and a method of the type mentioned at the beginning.

According to the invention, this object is achieved by way of the features as claimed. Advantageous further embodiments of the invention become apparent from the dependent claims.

In this, a liquid tank is arranged on the work- or rescue vehicle, with a fan having a liquid spraying device being connected to the liquid tank for producing a spray mist, wherein the work- or rescue vehicle is designed as a traction vehicle for pulling or pushing another rail vehicle. A work- or rescue vehicle of this kind is able to navigate to a source of fire under the protection of the spray mist blown into the tunnel or the subway tube and, if required, pull or push a damaged rail vehicle out of a danger zone. During this, the spray mist provides cooling and drives away flue gases, so that safe traversing of the tunnel or the subway tube is ensured.

In this, it is advantageous if the work- or rescue vehicle is designed as a formation of coupled cars, wherein one of the cars serves as a tank car. Thus, the tank car including the liquid tank situated thereon can be integrated into the formation as a separate car. With this, different liquid quantities can be carried along, depending on the requirements.

In an improved variant, the tank car has two three-axle bogies. Then, even in the case of limited axle load, a sufficient liquid quantity can be carried along in order to produce spray mist during longer tunnel rides. In addition, the tank contents are available for fire-fighting equipment carried on the vehicle.

Favourably, the drive comprises hydrostatic drive units. In this manner, it is ensured that in an emergency operation heavy loads can be pulled or pushed from a danger zone. During this, hydrostatic drive units allow a precise speed control in order to adapt the driving speed to the prevailing conditions.

It is additionally advantageous if a compressed-air container is present from which a driver's cabin can be supplied with air. As a result of this measure, driver's cabins as well as crew cabins or first-aid stations remain smoke-free in a response situation. It is not necessary then to don protective clothes or face masks in the vehicle.

If the drive comprises a combustion engine, it is favourable if the same can be operated for a limited time with air from the compressed-air container. Then, the combustion engine is available even during an oxygen deficiency, so that the vehicle can be moved out of a danger zone.

In a further variant, the drive comprises electric motors which can be operated by means of a power store arranged in the work- or rescue vehicle. Here also, any oxygen deficiency resulting from a tunnel fire does not have an adverse effect on the drive. In this, prior to entering a danger zone, the power store is charged by means of a generator, or by means of a converter from a catenary of the track.

A further safeguard for maintaining the vehicle functions provides that spraying devices for liquid mist cooling of drive components are arranged at an outer side. With this, any overheating of components required for the motive drive is prevented.

For quick removal, it is advantageous if a remote-controllable or automatic mechanical coupling is arranged on at least one front side of the work- or rescue vehicle. The coupling-up of a damaged rail vehicle can then take place without endangering any rescue personnel.

In the method according to the invention, it is provided that the work- or rescue vehicle moves in the direction of a damaged rail vehicle with switched-on fan, that the damaged rail vehicle is coupled to the work- or rescue vehicle, and that the damaged rail vehicle is pulled or pushed from the tunnel or the subway tub. The continuing cooling by means of spray mist provides for containment of the fire. In this manner, persons situated in the rail vehicle can be attended to in the quickest possible way.

BRIEF DESCRIPTION OF THE DRAWINGS

The invention will be described by way of example below with reference to the attached figures. There is shown in schematic representation in.

DESCRIPTION OF THE EMBODIMENTS

Figure 1:
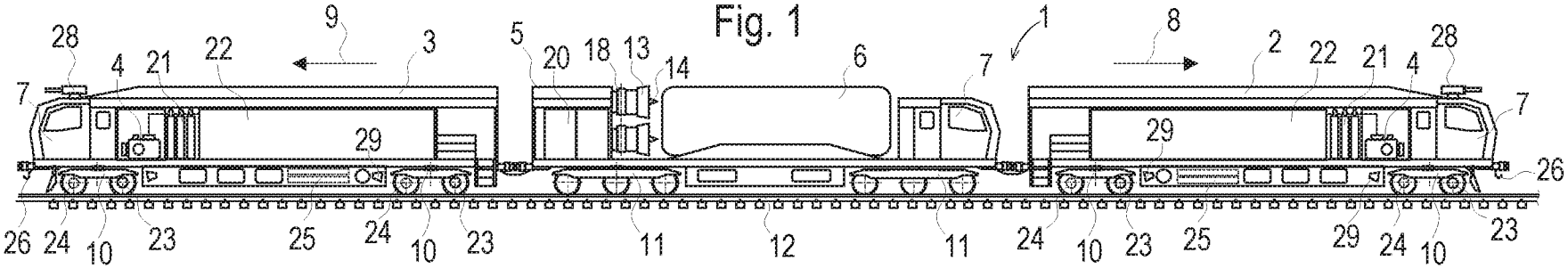
FIG. 1 side view of work- or rescue vehicle

The work- or rescue vehicle 1 shown in FIG. 1 comprises three cars coupled to one another. The two outer cars are designed as first and second traction vehicle 2, 3, each having a separate drive 4. Arranged there between as a central car is a tank car 5 with a liquid tank 6. Arranged at each front side of the work- or rescue vehicle 1 is a driver's cabin 7 with a control stand. The car formation can be moved in either travel direction 8, 9 from each control stand.

Optionally, the tank car 5 is also equipped with a separate drive in order to be autonomously mobile in the uncoupled state, or to ensure greater traction of the car formation. The two traction vehicles 2, 3 are mobile on a track 12 by means of two two-axle bogies 10, and the tank car 5 by means of two three-axle bogies 11. The three-axle bogies 11 make possible a large-volume liquid tank 6 (for example, 50 000 l) in the case of limited axle load. The tank 6 is filled with water, for instance.

Additionally, fans 13 having liquid spray devices 14 are arranged on the tank car 5. Preferably, nozzles are integrated into the fans 13 as liquid spray devices 14 which are connected via pipes, fittings and pumps to the liquid tank 6. The switched-on fans 13 produce a spray mist 15 (for example, water mist or high expansion foam) which, in a tunnel or a subway tube 16, curtails smoke 17 and heat build-up. Preferably, two fans 13 are arranged one above the other on each side.

A suspension 18 of the respective fan 13 is advantageously designed to be adjustable, so that the particular fan 13 is pivotable about a vertical axis over approximately 180°. In this manner, the spraying direction of the particular fan 13 can be oriented in one of the two travel directions 8, 9, selectively. With this, it is ensured that the work- or rescue vehicle 1 can approach a fire source 19 in either direction 8, 9. The suspension 18 consists, for example, of a bracket with a pivotable jib arm on which the associated fan 13 is fastened. For pivoting the jib arm, a drive (for example, a hydraulic cylinder) is arranged at the bracket. Connecting lines to the liquid tank 6 are formed flexibly.

Additionally arranged at the tank car 5 is an equipment container 20 in which pumps for the spray mist production and supply units for the fans 13 are accommodated. The fans 13 and the various units are controlled from the control stand 7 of the tank car 5. The motive drive of the work- or rescue vehicle 1 can also be controlled from this control stand 7 if, for example, the traction vehicle 2 shown at the right-hand side in FIG. 1 is uncoupled.

In a preferred variant, the respective motive drive 4 comprises a combustion engine which requires oxygen for operation. In order to maintain the functionality of the combustion engine also in low-oxygen environments, the work- or rescue vehicle 1 carries along compressed-air containers 21. As soon as a sensor indicates too low oxygen content in the ambient air, an air supply from the contained-air containers 21 is activated. This takes place by means of electrically controlled pneumatic valves. In an intermediate phase, ambient air can still be used. During this, there is a switch-over from an upper air intake (standard operation) to a lower air intake, because the smoke 17 spreads first along the tunnel ceiling.

Beyond that, the compressed-air containers 21 serve to supply the driver's cabins 7 and the crew cabins or first-aid rooms 22 which are set up in the traction vehicles 2, 3 and can be accessed via front-side platforms. In this, a slight positive pressure is produced in the cabins 7, 22 via automatically controlled valves in order to prevent smoke gasses from entering.

The combustion engine drives hydraulic pumps via a gear unit to supply a hydraulic system. Each powered bogie 10 comprises hydrostatic drive units 23 which can be actuated via a control circuit with the provided hydraulic pressure. This enables from a standing start a high traction with step-less speed default in order to pull or push heavy loads from a danger zone.

An alternative solution provides an electric drive, wherein electric motors 24 are arranged at the powered bogies 10. In this variant, the work- or rescue vehicle 1 comprises a power store 25 (accumulator) which is charged prior to entering a danger zone. In the danger zone, the electric motors 24 are supplied by means of the power store 25.

Arranged at the front sides of the work- or rescue vehicle 1 in each case is an automatic or remote-controllable mechanical coupling 26. By means of the latter, a damaged rail vehicle 27 can be coupled to the work- or rescue vehicle 1 and pulled from a danger zone. As is the case with the cabin ventilation, this device also serves for safety of the personnel in that all rescue measures can be carried out from inside the vehicle 1.

For the purpose of fire fighting, extinguishing devices 28 are arranged on the work- or rescue vehicle 1. These are connected to the tank car 6 and can also be controlled from the driver's cabins 7. Optionally, additional extinguishing means can be carried along in separate containers and fed to the extinguishing devices 28.

Arranged at the outer side of the work- or rescue vehicle 1 are spraying devices 29 for liquid cooling of drive components. These devices are connected via pipes to the liquid tank 7 and are activated as soon as the vehicle 1 enters a danger zone. Thus it is ensured that the handling characteristics remain intact for leaving the danger zone even in the event of an advanced fire impact and correspondingly high temperatures.

Figure 2:
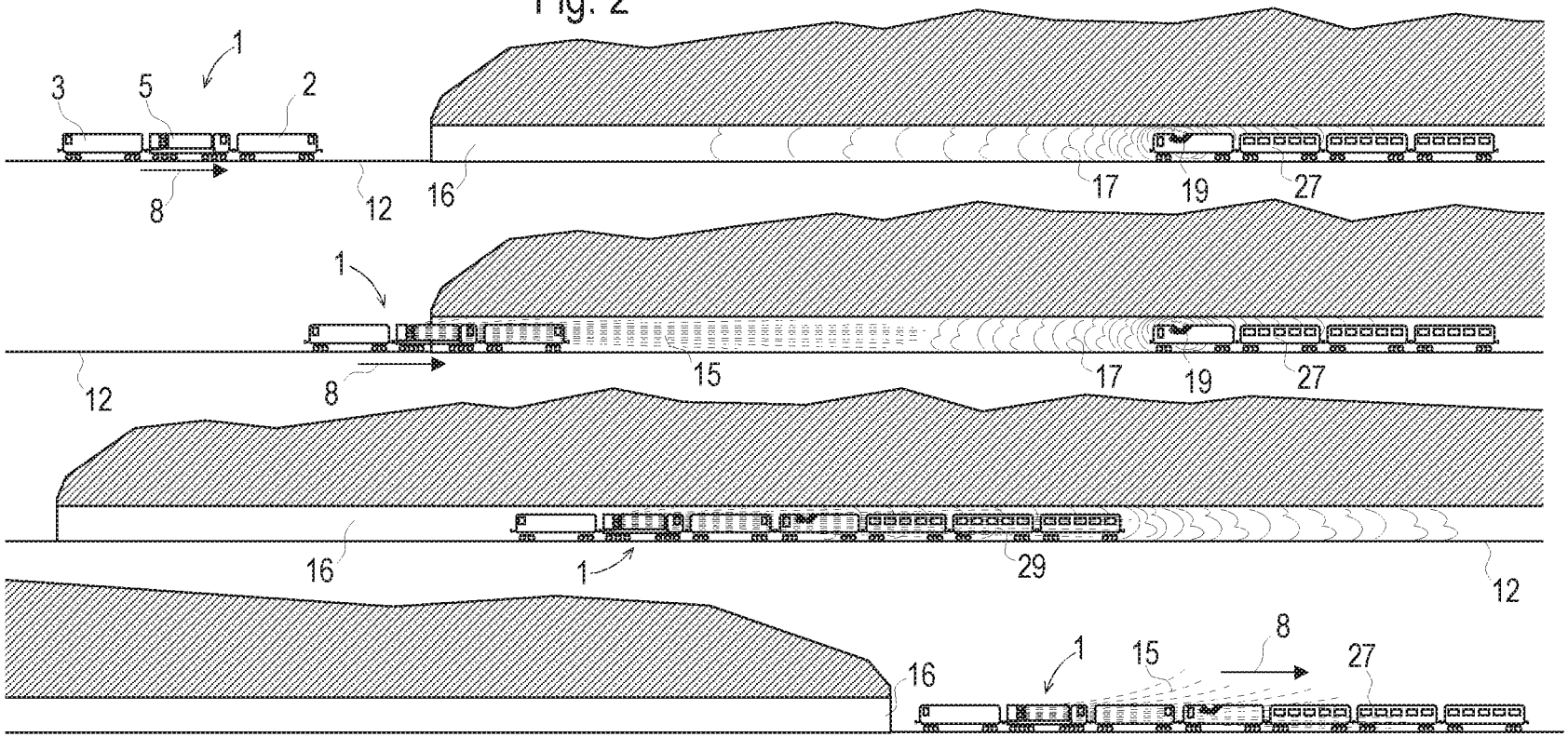
FIG. 2 process sequence when rescuing a rail vehicle

Shown in FIG. 2 is a preferred process flow of the method according to the invention. In this, a chronological sequence of the method steps is shown from top to bottom. A danger situation is caused, for example, by a rail vehicle 27 (a passenger train, for instance) caught on fire in a tunnel 16. Via known reporting systems, such a danger incident is immediately reported to a central office of a railway administration. Following this, the fire fighting- or rescuing procedure is started up in that the work- or rescue vehicle 1 moves in the direction of the accident place. During this, both travel directions 8, 9 of the work- or rescue vehicle 1 are possible.

In the example according to FIG. 2, the work- or rescue vehicle 1 moves in a first travel direction 8, wherein the fans 13 with the liquid spray devices 14 are actuated already prior to entering the tunnel 16. By means of the suspensions 18, these fans are oriented in the travel direction 8, projecting laterally, and curtail the smoke 17 and the heat in the tunnel 16.

As soon as the work- or rescue vehicle 1 reaches the damaged rail vehicle 27, the two vehicles 1, 27 are coupled. This takes place either by contact of buffers in order to push the damaged rail vehicle 27 out of the danger zone, as shown in FIG. 2. Or the work- or rescue vehicle 1 activates the automatic mechanical coupling 26 in the shape of a draw hook to pull the damaged rail vehicle 27 from the danger zone. During this, the fans 13 remain active in order to further contain the fire source 19 and the smoke 17. Additionally, the extinguishing devices 28 may be employed.

After leaving the tunnel 16, injured persons can be immediately attended to in the first-aid rooms 22 of the work- or rescue vehicle 1. In the case of smaller incidents with instant extinguishing of the fire source 19, this can take place already in the tunnel 16. The same goes for particularly heavy accidents with a blocked rail vehicle 27. Then, the rescuing of persons takes place in the tunnel 16 by appropriately equipped rescue personnel in the protection of the spray mist 15. During this, the traction vehicle 3 at the exit side can be uncoupled to take the persons to safety. The other traction vehicle 2 with the tank car 6 remains in the tunnel 16 to extinguish the fire source 19.

If the damaged vehicle 27 has been pushed out of the tunnel 16, as shown in FIG. 2, the work- or rescue vehicle 1 can move back into the tunnel 16 in the opposite travel direction 9. During this, the fans 13 can also be pivoted in the opposite direction 9 to extinguish equipment of the tunnel 16 caught on fire and to contain heat development. In this case also, one of the traction vehicles 2 can be uncoupled beforehand to attend to injured persons.

The method shown FIG. 2 can also be carried out by means of a work- or rescue vehicle 1 consisting of one car. However, the design as a train formation allows higher flexibility in fire fighting and rescuing of persons. In addition, various variants of the tank car 5 can be integrated in the train formation in order to meet different requirements (for example, different tank sizes). Also, several tank cars 5 can be used in a formation with one or two traction vehicles 2, 3 to extend the operational possibilities.

The invention claimed is:

1. An on-track work or rescue vehicle, comprising:

a drive configured for operation, at least for a limited duration, without ambient air;

a liquid tank supported on the vehicle;

a fan with a liquid spraying device connected to said liquid tank for producing a spray mist; and a mechanical coupling disposed on at least one front side of the vehicle;

wherein the work or rescue vehicle is configured as a traction vehicle for pulling or pushing another rail vehicle; and wherein said mechanical coupling is a remote-controllable coupling or an automatic coupling.

2. The work or rescue vehicle according to claim 1 specifically configured for fire-fighting and/or rescue of persons in tunnels or subway tubes.

3. The work or rescue vehicle according to claim 1, comprising a formation of coupled cars, including a tank car.

4. The work or rescue vehicle according to claim 3, wherein said tank car has two three-axle bogies.

5. The work or rescue vehicle according to claim 1, wherein said drive comprises hydrostatic drive units.

6. The work or rescue vehicle according to claim 1, further comprising a compressed-air container configured for supplying a driver's cabin with air.

7. The work or rescue vehicle according to claim 6, wherein said drive comprises a combustion engine configured to be operated for a limited time with air from said compressed-air container.

8. The work or rescue vehicle according to claim 1, wherein said drive comprises electric motors to be operated by way of a power storage device disposed on the work or rescue vehicle.

9. The work or rescue vehicle according to claim 1, further comprising spraying devices for liquid mist cooling of drive components arranged at an outer side of the vehicle.

10. A method for fire fighting and/or rescuing persons in a tunnel or subway tube, the method comprising:

providing a work or rescue vehicle according to claim 1;

moving the work or rescue vehicle in a direction of a damaged rail vehicle while the fan is switched on;

coupling the damaged rail vehicle to the work or rescue vehicle, and pulling or pushing the damaged rail vehicle from the tunnel or the subway tube.

* * * * *